US009823032B2

(12) United States Patent
Allan

(10) Patent No.: US 9,823,032 B2
(45) Date of Patent: Nov. 21, 2017

(54) APPARATUS FOR FIREARM SAFETY

(71) Applicant: Robert M. Allan, La Jolla, CA (US)

(72) Inventor: Robert M. Allan, La Jolla, CA (US)

( * ) Notice: Subject to any disclaimer, the term of this patent is extended or adjusted under 35 U.S.C. 154(b) by 0 days.

(21) Appl. No.: 15/232,190

(22) Filed: Aug. 9, 2016

(65) Prior Publication Data

US 2016/0348994 A1 Dec. 1, 2016

Related U.S. Application Data

(63) Continuation of application No. 14/312,881, filed on Jun. 24, 2014, now Pat. No. 9,441,896.

(60) Provisional application No. 61/966,788, filed on Mar. 4, 2014.

(51) Int. Cl.

| | |
|---|---|
| ***F41A 17/00*** | (2006.01) |
| ***F41A 17/46*** | (2006.01) |
| ***F41A 17/06*** | (2006.01) |
| ***F41A 17/30*** | (2006.01) |

(52) U.S. Cl.

CPC ..... *F41A 17/46* (2013.01); *F41A 17/06* (2013.01); *F41A 17/30* (2013.01)

(58) Field of Classification Search

CPC ..... F41A 17/20; F41A 17/22; F41A 17/46

See application file for complete search history.

(56) References Cited

U.S. PATENT DOCUMENTS

| | | | | |
|---|---|---|---|---|
| 2,654,174 A | | 10/1953 | Hansen | |
| 4,391,058 A | * | 7/1983 | Casull | F41A 19/30 42/69.02 |
| 4,488,370 A | | 12/1984 | Lemelson | |
| 5,168,114 A | | 12/1992 | Enget | |
| 5,448,847 A | | 9/1995 | Teetzel | |
| 5,517,780 A | | 5/1996 | Haber et al. | |
| 5,903,994 A | * | 5/1999 | Tange | F41A 11/00 42/70.01 |
| 6,415,542 B1 | | 7/2002 | Bates et al. | |
| 6,442,880 B1 | | 9/2002 | Allan | |
| 7,293,385 B2 | | 11/2007 | McCormick | |
| 7,398,723 B1 | | 7/2008 | Blakley | |
| 2005/0241470 A1 | | 11/2005 | Hochstrate et al. | |
| 2009/0255160 A1 | | 10/2009 | Summers | |
| 2013/0019510 A1 | | 1/2013 | Kemmerer et al. | |
| 2013/0118050 A1 | | 5/2013 | Alicea | |
| 2014/0215881 A1 | | 8/2014 | Milde, Jr. et al. | |

(Continued)

FOREIGN PATENT DOCUMENTS

| | | |
|---|---|---|
| GB | 263621 A | 1/1927 |

*Primary Examiner* — Gabriel Klein

(74) *Attorney, Agent, or Firm* — Studebaker & Brackett PC

(57) ABSTRACT

An apparatus includes a trigger assembly for initiating a firing of a firearm. The trigger assembly includes a trigger blocking portion. A safety selector lever is configured for joining to the firearm. The safety selector lever has an on position with the safety selector generally in a downward position and accessible to a user's thumb of a hand gripping a grip of the firearm. The safety selector is rotatable by the user's thumb to an off position where the user operates the trigger assembly while maintaining the safety selector in the off position. A safety cam is in engagement with a pivot end of the safety selector. The safety cam is configured for engaging the trigger blocking portion in the on position to inhibit the firing and for engaging the trigger blocking portion in the off position.

9 Claims, 3 Drawing Sheets

(56) References Cited

U.S. PATENT DOCUMENTS

| | | | | |
|---|---|---|---|---|
| 2014/0305017 | A1 | 10/2014 | Travis | |
| 2015/0027020 | A1* | 1/2015 | Sheets, Jr. | F41A 17/00 42/70.11 |
| 2016/0076842 | A1* | 3/2016 | Faxon | F41A 17/22 42/69.01 |
| 2016/0195352 | A1* | 7/2016 | Pikielny | F41A 17/20 42/69.01 |

* cited by examiner

APPARATUS FOR FIREARM SAFETY

CROSS-REFERENCE TO RELATED APPLICATIONS

This application claims the benefit of priority to U.S. patent application Ser. No. 14/312,881, filed on Jun. 24, 2014, which is a complete application of U.S. Provisional Appl. No. 61/966,788, filed on Mar. 4, 2014, which are hereby incorporated by reference in their entirety.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to firearms. More particularly, the invention relates to firearms with improved safeties to 1) allow faster response going from safe to fire modes, and automatic return to safe mode, 2) prevent unauthorized handling and theft, 3) provide a personalized firearm with an automatic processor controlled trigger lock, not requiring any external device, and locked safety assembly in a tamper proof compartment.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a firearm is a weapon that launches one or more projectile at high velocity through confined burning of a propellant.

Firearms using AR 15 and similar military type trigger assemblies typically use a safety selector lever that rotates a cam laterally above the extended back portion of the trigger. When the lever points to the rear, it is in its safe setting, the cam blocks the rear of the trigger from rising, and in front of the trigger's pivot point, the front sear of the trigger is prevented from dropping to release the hammer and fire the gun. Typically the shooter would carry an AR 15 with the end of their gun hand thumb resting on the left side of the lower receiver. To prepare to fire the AR 15, the end of the thumb must be moved back and up 2" in order to press the safety selector lever down and forward, then return to its original resting place, a total of 4". To return the gun to its safety setting the thumb must push the safety up and back, repeating the 4" of movement in reverse. Overall the unlocking and relocking cycle involves 8" of thumb movement. In contrast with the instant invention the thumb need only move about ½" to move the safety selector lever to its fire position, then simply release it to allow the internal spring to automatically return the safety to its safe setting. When a conventional AR 15 shooter reaches back and up with their thumb, this forces part of the gun hand to come off the grip at a critical time. When the trigger is pulled, using a conventional safety selector lever, the rear of the trigger over the cam can raise and front drop, due to opposing flats on the trigger and cam, this action requires a ¼ turn of the safety selector lever and cam. By comparison a shotgun's safety may only need a ¼" or less of thumb movement. A faster and easier to use safety for AR 15 type firearm is needed but the placement of AR 15 trigger mechanism components do not lend to the use of traditional safeties. The instant invention teaches the design of a safety selector lever that solves the described problems.

Typically, there are several types of mechanical thumb operated trigger locks and safeties that strive to prevent accidental discharge, injuries and death. Some owners may simply neglect to switch the safety back on, or decide not to because of the needed 4" of thumb movement and to be ready to go. If they trip, lean the gun against a tree or fence, the risk of accidental discharge is greatly increased. Occasionally an unauthorized child or person may switch the safety off and mistakenly fires a firearm thinking it was unloaded. Clamp on trigger locks may be used for pistols but unlikely are used for AR 15 type weapons. The military suffers from accidental shootings due to the safety lever not being reengaged after being placed in fire mode.

The AR 15 is the most popular rifle in the US, however it is believed many buyers do not have a gun safe to store them, relying on hiding them in the closet, or under the bed. Other than a safe or home security system, a hand gun type of trigger lock, even if used, permits the firearm to be stolen. It is estimated about 200,000 firearm are stolen every year. Many AR 15 owners likely do not have the room, money or inclination to own a gun safe. In many homes the AR 15 likely is the most valuable idem a thief could steal.

Unfortunately AR 15 have been used in well publicized mass shootings. The smart safeties disclosed in this patent application will guard against an AR 15 from being stolen and if stolen prevent it from being fired.

Typically, there is no practical defense against firearm theft. Stolen firearms often wind up on the street used in other crimes. There are currently no known commercially available firearms suitable for home defense that have an internal defense against being moved, stolen or unauthorized handling, including being taken to a school, other public place.

Typically there are no known commercially available firearms suitable for home defense, that warn an unauthorized user to put the firearm down, have an internal trigger lock to prevent unauthorized use by a child or others, that automatically locks the firearm if put down or taken away, or sounds an alarm in response to unauthorized handling or theft. Unauthorized use of a firearm requires 1) that it can be moved, and 2) the potential the trigger can be pulled, allowing the firearm to be fired. The instance invention processor, motion detector and alarm not only defend against the firearm being moved or stolen, but a second safety prevents the firearm from being firing.

The AR 15 is used by many of our troops along with many other firearm's using the same trigger, hammer and safety selector lever arrangement. The safety selector lever and its cam, referred herein as the "safety", are located above the natural position of the gun hand thumb when the weapon is griped. The safety is intended to be used to prevent accidental discharge, injury and death. Unfortunately the design is awkward to use, likely resulting in many users simply not using the safety. The AK 47 outsells the AR 15 on the world market. It appears an experienced shooter could go from safe to fire modes faster using the AK 47 than if he used the AR 15. It is unknown if tests have been conducted to compare how fast an AR 15 can go from safe to fire settings verses the AK 47. Overall the AR 15 shooter must move his thumb 4" compared about ½" with the disclosed invention. Likely the AR 15 shooter with the instant invention selector lever can go from safe to fire faster than the AK 47 shooter, a potential life and death issue. It is obvious a shooter who only needs to push their thumb ½" forward, could fire a lot faster than an someone who had to move their thumb 4", or their whole hand up and down as with the AK 47. The slowest shooter at a gun fight is at a disadvantage. Our troops should not be the slow ones in a firefight or competition.

The design and location of the conventional AR 15 safety selector lever is such that the side or back of the shooters thumb likely would be used to return to the safety on setting, which is cumbersome. The instant invention eliminates this problem by automatically returning to its "safety on position", when the thumb is released. This improvement likely can eliminate many friendly fire accidents. Troops would be less likely to carry their weapon with the safety off.

The electronic smart "PPS", or personal press safety feature in conjunction with the countdown warning light, alarm, and automatic trigger lock can prevent unauthorized handling, theft, accidents and the need to purchase an expensive gun safe.

The processor and timer permit military firearms to ultimately be controlled by superior officers over several years of use. As an example troops could be issued weapons that typically would be unlocked for 12 hours in the morning, yet automatically relock if left unattended beyond a time limit, requiring the press safety be entered. Every week or month a new press safety would be given out. A squad or larger of soldiers might use the same press safety. Each issued weapon would have years of monthly press safeties stored. A special press safety would be required to remove the smart grip from the lower receiver. Conventional grips will not fit on the lower receiver if the smart grip was cut off.

The US competes against Russia and others in international arms sales. The Russian AK 47 appears to have a faster to operate safety than the AR 15 and other U.S. military firearms. To compete internationally the US needs a faster to operate AR 15 and military arms. Our troops are deployed overseas, often with possible hostile locals in the area. The instant invention automatically guards against unauthorized handling and theft.

The US recently lost numerous firearms in Libya that were stolen. The disclosed firearms of this invention unlikely would have been stolen due to the security features.

In view of the foregoing, it is clear that these traditional techniques are far from perfect and leave room for more optimal approaches.

SUMMARY

This disclosure provides an apparatus comprising a trigger assembly, a safety selector lever, a safety cam, and a safety selector lever return mechanism. The trigger assembly is configured to initiate and to prevent a firing of a firearm. Said trigger assembly includes a trigger blocking portion and a trigger. The safety selector lever is positioned on the firearm, and said safety selector lever is configured to have an on position accessible to a user's thumb of a hand while the hand holds a grip of the firearm. Said safety selector lever is rotatable by the user's thumb to an off position through an angle of rotation of said safety selector lever from said on position to said off position so that the user is able to operate said trigger assembly while said safety selector lever is positioned in said off position with the thumb. The safety cam is engaged with a pivot end of said safety selector lever. The safety cam is configured to engage said trigger blocking portion of the trigger assembly to inhibit firing of the firearm when the safety selector lever and the safety cam are in a safety engaged position, and the safety cam is configured to disengage from said trigger blocking portion to enable firing of the firearm when the safety selector lever and the safety cam are in a safety disengaged position. The safety cam includes a recess portion facing downwardly in alignment with an upwardly angled feature of said trigger blocking portion in the safety disengaged position so that when said trigger is pulled, a rear portion of said trigger blocking portion rotates upwardly so that said trigger blocking portion rotates into said safety cam recess. Said trigger blocking portion rotation when said trigger is pulled is allowed by both of a recess of said trigger blocking portion and said recess in the safety cam, which in turn allows a desired minimum safety selector lever rotation to allow the firearm to be fired. The safety selector lever return mechanism is configured to return said safety selector lever to said on position when the user's thumb is removed from said safety selector lever.

This disclosure also provides a firearm comprising a grip, a trigger assembly, a safety selector lever, a safety cam, and a safety selector lever return mechanism. The trigger assembly includes a trigger blocking portion. The safety selector lever is moveable between an on position accessible to a user's thumb of a hand while the hand holds the grip, and an off position located so that the user is able to operate the trigger assembly while the safety selector lever is positioned in the off position with the thumb. The safety cam is engaged to and moveable with the safety selector lever, and the safety cam is moveable to engage the trigger blocking portion to inhibit firing of the firearm in a first, safety engaged position corresponding to the on position of the safety selector lever, and moveable to disengage from the trigger blocking portion to enable firing of the firearm in a second, safety disengaged position corresponding to the off position of the safety selector lever. The safety cam includes a recess portion oriented to be in alignment with a feature of the trigger blocking portion in the safety disengaged position and oriented to be out of alignment with the feature of the trigger blocking portion in the safety engaged position. The safety selector lever return mechanism is positioned to return the safety selector lever to the on position when the user's thumb is removed from the safety selector lever.

Advantages and features of the embodiments of this disclosure will become more apparent from the following detailed description of exemplary embodiments when viewed in conjunction with the accompanying drawings.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
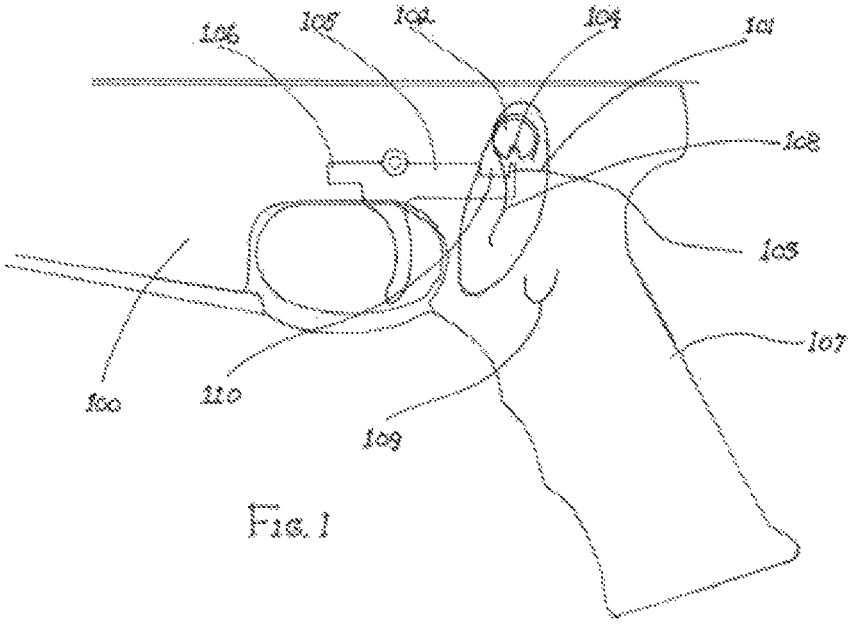
FIG. 1 illustrates a detailed perspective view of an exemplary firearm safety joined with a portion of the lower receiver of a firearm 100, in accordance with an embodiment of the present invention.

Unless otherwise indicated illustrations in the figures are not necessarily drawn to scale.

DETAILED DESCRIPTION

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub combination. The Applicants hereby give notice that new Claims may be formulated to such features and/or combinations of such features during the prosecution of the present application or of any further application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

A "processor" may refer to one or more apparatus and/or one or more systems that are capable of accepting a structured input, processing the structured input according to prescribed rules, and producing results of the processing as output. Examples of a processor may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

"Software" may refer to prescribed rules to operate a computer. Examples of software may include: code segments in one or more computer-readable languages; graphical and or/textual instructions; applets; pre-compiled code; interpreted code; compiled code; and computer programs.

A "computer-readable medium" may refer to any storage device used for storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

A non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; however, the non-transitory computer readable medium does not include a pure transitory signal per se.

The present invention will now be described in detail with reference to embodiments thereof as illustrated in the accompanying drawings.

A simplest form of this invention may be an improved safety selector lever, its cam and/or trigger assembly. This assembly may also be used in conjunction with various electronic embodiments of this invention.

There may be various types of firearm locking assemblies that may be provided as embodiments of the present invention. In one embodiment of the present invention, a firearm locking assembly may provide multiple locking modes and/or integrates into a firearm. In some embodiments, the firearm locking assembly may utilize various components, including, without limitation, access codes, personal press safety ("PPS"), a safety selector lever or grip switch, and a processor to switch between the various locking modes. In at least one embodiment, the firearm locking assembly may utilize a blocker and/or blocking element. In some embodiments, the blocking element may include a bar that may be any suitable shape, including, without limitation, round, rectangular or square. In some of these embodiments, the bar may be operable to restrict backward movement of a firearm trigger or trigger assembly to prevent discharge. However, in other embodiments, the blocking element may include, without limitation, a mechanical barrier of a variety of shapes and/or dimensions which may be configured to restrict movement of the trigger. In some embodiments, a safety selector lever cam may serve as part of a trigger blocking element in conjunction with a blocking bar or rod in one or more embodiments, a thumb safety lever may provide a tactile indication of whether a smart safety is engaged. In some embodiments, when a personal safety press ("PSP") is entered, a motor or other suitable device may move the blocking element.

In one embodiment of the present invention, a safety module with a rearward facing keyboard with pushbuttons and warning lights may allow a firearm to be unlocked through a predetermined personal code that may be entered using pushbuttons or other suitable input means. In some embodiments, a safety code and/or personal press safety portion may accept a predetermined amount of incorrect entries before performing panic procedures. In a non-limiting example, a personal press safety portion may accept 3 incorrect code entries, then not accept more attempts for 30 minutes, and cause an alarm to sound. In some embodiments, a processor may actuate a loud alarm for a given amount of time in response to other user actions. In a non-limiting example, a processor may actuate an alarm for 15 to 20 seconds after a firearm is moved as determined by a motion detector. In many embodiments, an assembly may also include, without limitation, a vibration motor to verify successful programming, an accelerometer, and a loud alarm portion for dissuading unauthorized handling. In some embodiments, a tamper resistant grip safety module may house safety components. In at least one embodiment, an alternative power source may provide backup power. In this manner, trial and error unlocking of the firearm or the defeating of the safety mechanism may be prevented.

In one embodiment of the present invention, the firearm locking assembly may include a multiplicity of modes that may provide different accessibility to the firearm. In many embodiments, a multiplicity of modes may include, without limitation, an alarm locked mode, a locked travel mode with the accelerometer/alarm off, an unlocked mode with automatic re-locking if the firearm is put down or taken, and a timed unlocked mode with automatic relocking after a programmed period of time, to prevent accidently leaving the firearm unlocked for a long period of time. In some embodiments, the locked mode may provide a physical barrier to prevent the firearm from discharging. The locked mode may include a restriction portion that may be positioned such that the trigger and/or the safety lever member may be above an end of the trigger. In at least one embodiment, the restriction portion may be internally located in the firearm to engage the trigger. In some embodiments, the restriction portion may serve as a physical barrier that may restrict rotation of the trigger, and thereby may prevent the trigger from discharging the firearm. In some embodiments, a motor may power the restriction portion to and from the trigger and/or the safety member. In some embodiments, a thumb safety lever may be positioned on an exterior of the firearm. In many embodiments, the safety lever may be configured to be operable to signal an owner if smart restriction portion blocks and/or allows the trigger assembly to discharge the firearm. In one or more embodiments, the safety lever may be configured to be operable to be pressed forward by pressure from a user's gun hand thumb. In some embodiments, the safety lever may be operatively joined to a processor and/or act as an electronic switch. In some of these embodiments, the processor may be programmed to actuate a motor to position the restriction portion upon the safety lever being pressed or released as a switch. However, in other embodiments, the processor may be operable to provide numerous other functions for the firearm locking assembly, including, without limitation, communicating with the owner, communicating with the access code portion, communicating that the code must be entered or the alarm will sound because the safety cannot be pressed forward, communicating via a light or lights on the control module keyboard, communicating with the motor, communicating with the power source and the alternative power source, communicating with the alarm portion, communicating with the GPS, communicating the firearm location to a remote receiver, communicating that an accelerometer indicates the firearm has been fired, communicating with the vibration motor, communicating digital images of what the firearm was pointed at when fired or when the safety lever is pressed, communicating digital images of the party holding the firearm when a false access code is entered. Those skilled in the art, in light of the present teachings, will recognize that the camera feature may help identify if and when an officer is justified in discharging the firearm.

In one embodiment of the present invention, the firearm safety assembly may be operable to automatically regulate functions of a firearm through the use of, without limitation, an accelerometer, a processor, a code entry, and a timer. In some embodiments, the firearm safety assembly may be un-locked by a pushbutton combination lock that may prevent unauthorized access to the safety assembly without first entering the correct push code. In some embodiments, the code may be set very short with 2 or 3 numbers, potentially allowing unauthorized trial and error attempts to unlock the firearm. In at least one embodiment, to mitigate unauthorized access, the processor may for 30 minutes prevent more than 3 wrong code entries. Moreover, in some embodiments, to further protect against unauthorized handling the motion detector may alert the processor if the firearm was moved cumulatively over 20 seconds over 30 minutes, and if so the alarm may commence to sound. In many embodiments, when the alarm is triggered, the code may be entered to cancel it.

In one embodiment of the present invention, the keyboard may include, without limitation, one or more back-lit pushbuttons and/or one or more LED lights. In a non-limiting example, a keyboard may have three back-lit pushbuttons and one greed LED light. In the present non-limiting example, when firearm is picked up the processor and motion detector may cause the green light to blink once per second for 10 seconds as a warning, then yellow that the code must be entered or the alarm will sound if the code is not entered or if the firearm is not put down; after 15 seconds a 1 second alarm will sound the warning light blinks red very rapidly as a final warning. Further, in the present non-limiting example, after 20 seconds the alarm may begin to sound and continue until the personal safety is entered. In some instances, a purpose of the warning blinking lights, motion detector and/or alarm may not be to warn the owner or an unauthorized person that the firearm is unlocked or locked, or signal others the firearm is being handled, but to discourage unauthorized persons such a child, teenager or thief from handling or attempting to unlock the firearm in the first place, without the alarm ever having to sound. In some embodiments, the owner may be warned by the blinking light that the code may be entered. Those skilled in the art, in light of the present teachings, will recognize that police officers, may select an embodiment using a 3 press personal safety, then pre enter two presses leaving 1 press to unlock. As there are 12 possible 1 press combinations, 144-2 press and over 1500 3 press possible combinations, the odds of an assailant taking an officers weapon away, guessing which and how many presses are needed, appears slight.

In some embodiments a police officer, soldier or homeowner may simply enter all but a last 1 or 2 presses, then put the firearm aside, and the motion detector may be automatically off for 24 hours and the firearm locked. In some of these embodiments, remaining single press or presses may be entered to unlock the firearm. In at least one embodiment, if the firearm was locked and wrestled away the advisory would have to correctly guess the necessary presses and risk setting off the alarm. In some embodiments, during an initial 24 hours the firearm could be handled without setting off the alarm.

In many embodiments, if the alarm is triggered to stop the alarm the full code should be entered. In some embodiments, an advisory's risk for a wrong entry could be a silent alarm which may send a signal to police headquarters, a military headquarters or a security company, and/or a loud alarm would sound.

In some embodiments, the assembly may include, without limitation, an unlocked mode that may allow the firearm to discharge. In some of these embodiments, the unlocked mode may function to disengage the restriction portion from the trigger. In one or more embodiments, an access code portion may be operatively joined with the processor for switching between the modes. In a few embodiments, the control module may include a plurality of buttons that may be depressed in combination to switch between modes. In some embodiments, the firearm locking assembly may switch between each mode depending on the manipulation of the access code portion, the processor commands.

In one embodiment of the present invention, the firearm locking assembly may include a firearm. In some embodiments, the firearm locking assembly may be integrated into the firearm. However, in other embodiments, the firearm locking assembly may detachably join the firearm. In some embodiments, the firearm may include, without limitation, a handgun, a pistol, a rifle, an AR 15, an M 16, other military type weapons and a shotgun. In many embodiments, the firearm may include a trigger configured to engage a triggering object. In some of these embodiments, the trigger may provide an exterior access for firing the firearm. In some embodiments, the firearm may include a grip. In some of these embodiments, the grip may be operable to be held by a hand. Moreover, in some of these embodiments, the grip may include a pressure sensitive switch. In at least one embodiment, the switch may be configured to be operable to be depressed by pressure from a hand. In some embodiments, a grip switch may initiate the functional aspects of the firearm locking assembly by communicating with the processor, actuating an alarm, and operatively joining with the access code portion.

In some embodiments, a safety control module may be positioned in proximity to the grip and operatively joined with the processor. In some of these embodiments, the safety control module may include, without limitation, warning LED lights, push buttons, a camera and or a laser for sighting. In a non-limiting example, in a military situation an ergonomically placed keypad having a multiplicity of buttons could program the processor to require a different smart push safety every day, week or month. In the present non-limiting example, the government could control supplying smart push codes in the future, in order to keep friendly troops friendly, or deny firearm use.

In many embodiments, the multiplicity of buttons may be depressed in predetermined combinations to communicate with the processor for locking or unlocking the firearm. In some embodiments, manipulating the multiplicity of buttons on the smart safety module may provide communication with the processor to switch the firearm locking assembly between each mode.

In one embodiment of the present invention, the firearm locking assembly may include an alarm portion to dissuade an unauthorized person from handling the firearm in the first place, or trial and error attempts to get the correct combination. In a non-limiting example, three wrong attempts lock the weapon down for 30 minutes. In the present non-limiting example, when the firearm is moved a warning light on the keyboard would blink green once per second for 10, seconds, amber for 6 seconds, then red to dissuade handling. In many instances, even if no one was within listening distance to be alerted, the mere prospect of a loud alarm sounding should persuade most unauthorized persons to put the firearm down. In some embodiments, the alarm portion may alert with an illumination or an audio signal. However, in one embodiment, the alarm portion may alert inaudibly. In one embodiment, the alarm portion may sound if a specific button is depressed, or if the access code portion has not been manipulated in a predetermined amount of time. In some embodiments, the alarm portion may include a motion sensor. In some of these embodiments, the processor may actuate the alarm portion when the motion detector detects movement and the safety control module is not properly manipulated.

In some embodiments, the grip safety assembly portion may include, without limitation, a motor and a trigger assembly blocker. In some of these embodiments, a restriction portion or blocker may be advanced and/or retracted by a threaded motor shaft to alternatively block and unblock the trigger. In at least one embodiment, when the processor detects low power in the power source, it may automatically alert the operator by use of the keyboard lights.

In one embodiment, pushbuttons may signal the processor to put the assembly into timed unlocked mode.

Those skilled in the art, in light of the present teachings, may recognize personalized firearm locking designs based on fingerprint reading technology, biometrics, chips placed under the skin, special rings or wrist watches that lock the trigger but do not lock access to the firearm locking assembly, would be vulnerable to tampering and possible defeat of the firearm locking assembly. A so called smart gun that contains a trigger lock, that allows access to the safety components by the removal of a screw or pins, so that the safety can be defeated, is flawed. In many embodiments, the safety assembly requires the gun be unlocked before the safety assembly may be accessed. Moreover the motion detector and alarm, combined with programming to deny access after wrong entries, are configured to deny prolonged trial and error attempts to unlock.

In some embodiments, the disclosed firearm locking assembly may utilize a 100+ decibel alarm that may operatively join with the processor and a portion detector. In a non-limiting example, the firearm may sound its alarm if the personal safety code is not entered within 20 seconds of the firearm being picked up. In this manner an unauthorized person may have very little time to try to defeat the personalized locking assembly or commit theft. In some embodiments, the firearm may be programmed to have the alarm sound when the safety lever is released, or shortly thereafter, in case of a takeaway situation. In some of these embodiments, firearm may cancel alarm if any button is pressed before the safety lever is released. In many embodiments, the firearm locking assembly may further utilize, without limitation, lights associated with the access code portion, a timer and/or an accelerometer to safeguard against theft, tampering and/or unauthorized handling by children and others. In some embodiments, firearms intended for hunting or being retrofitted may not utilize a motor, restriction portion, or safety selector lever to prevent the firearm from firing, and instead may use the accelerometer to alert the processor of movement requiring the access code be used or the firearm put down within the programmed period of time, and if not the alarm may begin to sound an alarm as programmed, making theft or unauthorized handling impractical.

FIG. 1 illustrates a detailed perspective view of an exemplary firearm safety joined with a portion of the lower receiver of a firearm 100, in accordance with an embodiment of the present invention. In the present embodiment, a smart safety lever 101, which may replace a conventional safety selector lever, may point generally down to slightly forward in this view in a safety off position, and may generally be flat against a lower receiver. Further, in the present embodiment, a smart safety cam 102 may extend laterally from a pivot end of the smart safety lever 101, over a rear portion of a trigger blocking element 103. Still further, in the present embodiment, a trigger 105 may be configured at 110 to permit a trigger blocking element to raise and not be blocked by the cam at 104, which may permit the safety lever and/or cam to only rotate a little instead of a normal 90-degree rotation for an AR 15 and M 16. In some embodiments, if the safety lever and/or cam are being used to select, without limitation, semi-automatic, burst and/or automatic fire, a cam opening at 104 may be larger to permit the cam more rotation. In one or more embodiments, if the safety is pulled back to its safety on position at 109, or pushed back by spring 108, a recess 104 in the cam may rotate so that the trigger blocker may not be aligned, and the cam may prevent the rear of the trigger from rising, which may prevent the trigger from being pulled. If the cam rotates to permit the trigger blocker to raise, the trigger may be pulled to allow its front end shear 106 to drop, to release the hammer and fire the firearm.

Figure 2:
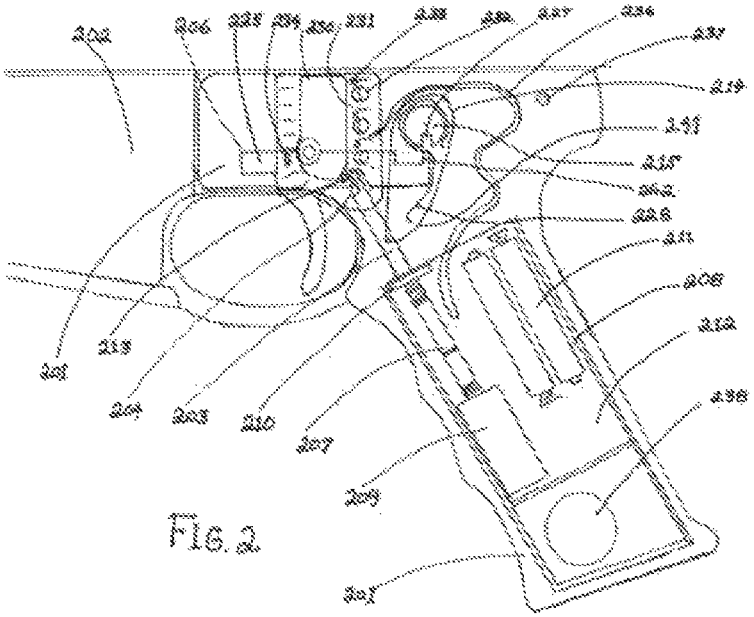
FIG. 2 illustrates a detailed perspective view of an exemplary grip safety assembly 201 joined with an exemplary lower receiver 202 of a firearm in an exemplary smart locked mode, in accordance with an embodiment of the present invention.

FIG. 2 illustrates a detailed perspective view of an exemplary grip safety assembly 201 joined with an exemplary lower receiver 202 of a firearm in an exemplary smart locked mode, in accordance with an embodiment of the present invention. This weapon may have five or more safeties. In the present embodiment, a countdown warning light safety 231 may alert a person that the firearm may be put down and/or PPs entered, a motion detector activated alarm 238, a spring and thumb actuated automatic mechanical thumb safety lever 214, a pushbutton automatic electronic trigger lock with a timer 232, a trigger blocking element safety rod 203 that may also lock a grip safety assembly 201 to the lower receiver to prevent disabling of the safety assembly.

In the present embodiment, a processor 212 may direct a motor 209 to rotate a threaded shaft 207. In some embodiments, the threaded shaft 207 may push a threaded connector 210 forward. In some of these embodiments, the threaded connector 210 may push a blocking element or rod 203 forward into a recess 204 in a trigger 225 to prevent the trigger from rotating to drop a shear 206 and release the hammer. In at least one embodiment, the safety lever 214 may be held forward by a gun hand thumb at 241, so that a cam 215 may permit a trigger blocking element 242 to raise, so that the trigger may be pulled after an owner enters his or her personal press safety via keyboard pushbuttons 232, which may cause the blocking element to be retracted. In some embodiments, the grip assembly 201 may contain a locked and/or watertight safety assembly 208 which may contain, without limitation, the gear motor 209, threaded shaft, connector, batteries 211, and a piezo alarm 238, configured to produce 100 decibels, to dissuade theft and unauthorized handling when triggered by the motion detector and timer mounted on the processor.

In one or more embodiments, a smart control module 230 may have a camera and lens 234 that alternatively may be located elsewhere on the firearm, and a warning light 213, in addition to the pushbuttons and lights. In other embodiments, a laser may be located at 234.

In some embodiments, the processor may contain a silent alarm such as, without limitation, an FM transmitter and GPS device to communicate that the firearm is being handled or stolen if the PPS was not entered triggering the alarm. In many instances, military firearms in storage overseas thus could be secured.

In the present embodiment, the firearm locking assembly may include an unlocked mode that may allow the firearm to discharge. In some embodiments, the unlocked mode may function to disengage the blocking element from the trigger. In this manner, the trigger may freely move for discharging the firearm. In some embodiments, a smart control module may be operatively joined with a processor using a cable 236 for entering the owner's personal press safety. In some of these embodiments, the safety control module may include a plurality of buttons 232 that may be depressed in combination to switch between modes. Those skilled in the art, in light of the present teachings will recognize that myriad combinations of button manipulation may be utilized for any function of the firearm locking assembly. In one embodiment, the multiplicity of buttons may include 2 or 3 buttons in a row on a keypad measuring approximately 1.".times.0.4". Those skilled in the art, in light of the present teachings will recognize that a 3 button keypad would have the equivalent of 12 buttons if the processor is programmed to regulate the pressing of 2 buttons at once as additional numbers and regulating a less than 0.5 second as 1 number and over 0.5 second as another. For example, without limitation, 3 buttons may be positioned close together in a row to allow the users thumb to press 2 buttons at once. In this embodiment buttons 1 and 2 pressed at once may be the equivalent of button 4, buttons 2 and 3 the equivalent of button 5, 1 and 3 the equivalent of button 6. In many embodiments, 6 press combinations may double to 12 as the software may regulate regular and slightly longer presses as different presses. In some embodiments, a 3 button keyboard may have the equivalent of 12 buttons, if pressed only once, twice 144 possible PPS and 3 times over 1700 PPS. In many instances, an unauthorized person may not know if 1, 2 or 3 presses were needed, or if just 1 press would cause the alarm to sound.

In yet another embodiment, a law enforcement officer may chose a single press for a safety for daily carry with an alarm to sound with a single wrong press or if the weapon is unlocked and the safety lever released, the alarm may sound unless all 3 buttons are pressed to cancel. In one embodiment the grip safety assembly is attached to the lower receiver vertically and must be removed vertically. The takedown pin 237 has been redesigned to both connect the lower receiver to the gun's upper half but connect the grip safety assembly to the lower receiver. To disconnect the grip safety assembly from the lower receiver the takedown pin must be pushed through and the safety rod 203 fully retracted into the grip safety module 208.

In some embodiments, the firearm locking assembly may include a plurality of modes operable to restrict use of a firearm. In some of these embodiments, an accelerometer may be configured to detect potential unauthorized handling. In many embodiments, a timer associated with the processor may allow a programmed amount of time such as, without limitation, 20 seconds for an authorizing code to be entered by the use of a plurality of buttons on a rearward facing keyboard. In some embodiments, the smart control module may include, without limitation, a keyboard, a digital display, a switch system, warning lights, digital camera components, silent alarm FM and GPS components.

In one embodiment of the present invention, the motor 209 may power the blocker 203 to and from the trigger recess 204. In some embodiments, the motor 209 may include a threaded motor shaft 207 connecting to a threaded connector 210 that may orient 90 degrees so that when the motor is powered, the threaded motor shaft 207 may extend and/or retract the connector through the threaded aperture in the connector, that in turn may extend and/or retract the blocker to lock or unlock the trigger. In one alternative embodiment, an illumination portion 232 may be used to signify each mode. In some embodiments, the illumination portion may include, without limitation, colored lights. Those skilled in the art, in light of the present teachings will recognize that in emergency situations the mode of the firearm may be important to discern by feel and through a quick visual inspection.

In some embodiments, the processor may be programmed to actuate the motor to position the blocker in response to the personal press safety or PPS being entered. However, in other embodiments, the processor may be operable to provide numerous other functions for the firearm safety mechanism, including, without limitation, communicating with the safety, communicating with the smart control module, communicating with the motion detector, communicating with the vibration motor, communicating with the motor, communicating with a camera, communicating with a GPS, communicating via a FM radio, communicating with a lazier, communicating with a flashlight communicating with the a police station, security service or others that unauthorized firearm handling occurred via a silent alarm, communicating with an unauthorized person via warning lights and or an audio alarm to put the weapon down, communicating via lights that the power source was low and should be changed, communicating with the power source and the alternative power source.

In one embodiment of the present invention, the firearm locking assembly may include an alarm portion for dissuading an unauthorized person from stealing or handling the weapon. In at least one embodiment, an alarm portion may alert with an illumination or an audio signal. In some embodiments, the alarm portion may include a 100+ decibel audio signal. However, in one embodiment, the alarm portion may alert inaudibly. In one embodiment, the alarm portion may sound 20 seconds after the motion detector registers movement if the smart control module buttons have not received the personal press safety. In some embodiments, the alarm portion may include, without limitation, an accelerometer, processor and/or piezo speaker. In one embodiment, the accelerometer may be sufficiently sensitive to signal to the processor if the firearm is picked up by an unauthorized user. For example, without limitation, after the firearm is moved the alarm portion may blink a warning for 20 seconds and if the firearm is not put down or the PPS is not entered the alarm may sound. In one embodiment the alarm sounds a 1 second warning at 15 seconds. However, in other embodiments, different time frames a silent FM signal may send the GPS coordinates. In some embodiments, the power source may include, without limitation, a battery, and a thermal power source. In one embodiment, the power source may be positioned above the processor and adjacent to the motor.

In some embodiments, the firearm locking assembly may include an external power port for docking with an external power source, in the event the power source fails. For some embodiments, power failure may be unlikely as the processor may cause a warning light when the firearm is picked up, to blink green, yellow green etc. when the power source is, in a non-limiting example, 50% down. In another non-limiting example, when the power source is 75% down the warning light may blink yellow, yellow, green, then yellow, yellow red when 80% down. However in other embodiments, the firearm locking assembly may alert the owner by an illuminated light and/or alarm that the power source may need replacing.

In one embodiment of the present invention, an access code portion and a plurality of backlit buttons 232 positioned on a keyboard may be ergonomically oriented and aligned, to be seen by the owner when aiming the firearm. In alternative embodiments, lights 233 may be positioned adjacent to said buttons on a keypad. In some embodiments, the multiplicity of buttons may be positioned in a control module 230 in proximity to the grip and configured to be operable, such that a thumb may press either outer buttons, or either outer buttons and an adjacent button simultaneously. In some embodiments, a flush thumb safety 214 may be configured to allow the owner to reach and operate the pushbuttons on the keyboard with their thumb, which might not be possible with the raised safety selector lever currently used in the AR 15 and M 16. In one or more embodiments, the control module may house a laser and/or camera components.

Figure 3:
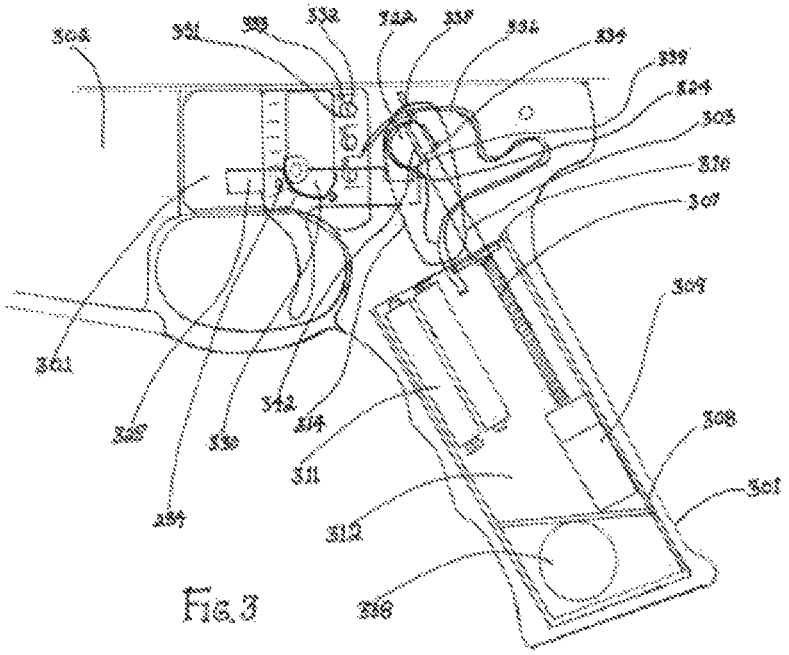
FIG. 3 illustrates a detailed perspective view of an exemplary grip safety firearm locking assembly 301 joined with a portion of an exemplary firearm lower receiver 302 in an exemplary smart safety locked mode, in accordance with an embodiment of the present invention.

FIG. 3 illustrates a detailed perspective view of an exemplary grip safety firearm locking assembly 301 joined with a portion of an exemplary firearm lower receiver 302 in an exemplary smart safety locked mode, in accordance with an embodiment of the present invention. In the present embodiment, unlike the grip safety assembly of FIG. 2, a shooter may not push the thumb safety 314 forward without first unlocking the smart electronic trigger lock, so as to avoid confusion under stress of whether the gun may be unlocked or not. Further, in the present embodiment, the traditional grip 107 of FIG. 1 has been replaced with grip safety assembly 301 that may fit over a lower receiver 302. In some embodiments, the motor 309, threaded shaft 307 and trigger blocking element 303, may be aligned off-center with a center of the cam 322. In the present embodiment, the smart safety lever 314 may be held in a safe position by a spring, may be pushed forward a comparatively short distance by the gun hand thumb into its safety off position, and unlike a conventional AR 15 safety selector lever, released by the thumb to automatically return to the safety on position.

In the present embodiment, a blocking element may be extended so that a wider of two narrower portions 334 may abut a narrower portion 342 of the cam 322, so that the smart thumb safety and its cam may not rotate to permit the trigger to be pulled. In some embodiments, an owner may confirm if the smart safety is locked simply by pushing the smart safety lever to see if it will go forward. In some of these embodiments, if the safety blocking element 310 is extended so that a narrower of two narrower portions abuts the cam at 342, the cam and safety lever may then rotate so that the cam may allow the trigger blocking element to rotate up to permit the firearm to be fired. FIG. 3 safety may require a hole be drilled in lower receiver frame, while FIG. 2 design may use an existing grip bolt hole that may align with the trigger and/or helps to retrofit AR 15s.

In one embodiment of the present invention, the smart safety assembly may include special law enforcement modes. For example, without limitation, a police department may adopt use of the Smart AR 15 to be carried in squad cars. In the present non-limiting example, a squad car may be notified to respond to reports of an active shooter at a mall. Further, in the present non-limiting example, officers may respond and unlock Smart AR 15s by inputting standardized Department's Press Safety or DPS, which may unlock smart safety and may trigger silent FM alarm. In the present non-limiting example, an FM transmitter may broadcast and identify weapon's GPS location to a portable command center. Further, in the present non-limiting example, command personnel may be able track locations of all police Smart AR 15s on a laptop map. Still further, in the present non-limiting example, if an officer loses or puts a weapon down, it may automatically relock due to non-movement. In some embodiments, if a weapon is fired, a motion detector may detect a kick and may send a special GPS signal. In a few embodiments, when the silent alarm is activated an officer may be able to broadcast his current status by using pushbuttons.

In one embodiment of the present invention, security personnel may be armed with locked Smart AR 15. In the present embodiment, if a guard is attacked and disarmed before being able to use a weapon, the weapon may not be unlocked and used against him, the public or other responding officers. In some embodiments, smart law enforcement weapons may be set so that when they are unlocked in an emergency or the correct combination of buttons are pressed a signal is sent to other security personnel or headquarters.

In one embodiment of the invention, false entries and/or failure to enter the personal press safety may cause a silent and/or audio alarm. In some embodiments, a 100+dB alarm may be loud enough to distract or detour an unauthorized person or thief and alert public and others of danger. In some of these embodiments, alarms may optionally be triggered by an officer simply by pressing and holding any button for 2.5 seconds.

In some instances, law enforcement personnel modes may be operable to prevent a criminal from forcibly obtaining a firearm. In some situations, law enforcement personnel modes may be used for civilian use. In a non-limiting example, a civilian attacked in their home who is unable to unlock a weapon in time, or if it is unloaded, might press any button to trigger the alarms.

In some embodiments, a device may have one or more buttons. In the present non-limiting example, a device may have three buttons. In the present embodiment, a device may determine whether a correct first button of a code has been pressed in. Further, in the present embodiment, if the correct first button has been pressed the device may continue a blinking warning light countdown until gun is put down, or a balance of code is entered and unlocks the gun, or a wrong entry is made and then an alarm may sound after time limit expires. In some embodiments, when a correct first code press is made, a gun may be in "hold to complete" until rest of the code is entered, with motion detector and/or alarm off for 24 hours. In some of these embodiments, after 24 hours the motion detector, countdown and alarm automatically reengage, however the owner could still keep the gun with only one or two presses needed to unlock, however only one try would be allowed using remainder of original 20-second time. In one embodiment, an owner could let remaining time go to a few seconds if desired. In some embodiments, the device may determine whether a specific first button has been pressed and cause an emergency alarm to sound. In other embodiments, the device may determine whether any button has been pressed. In some embodiments, device may have a timer that may require a same or a new code be entered every 24 hours, for years. In at least one embodiment, a special code may be needed to remove and access grip safety assembly, which if not accessed to replace batteries and/or extend the code life, would intentionally render gun useless. In the present embodiment, if a second button has been pressed, device may determine whether device timed out before second button was pressed in. In some embodiments, device may have the timer set for any time length. In a non-limiting example, a timer may be set for 20 seconds or 24 hours before the alarm sounds. In the present non-limiting example, if a user fails to correctly select the first press code of their code within 20 seconds of cumulative movement over 30 minutes, the processor will cause the alarm to sound. Further, in the present non-limiting example, if during said 20 seconds motion stops, countdown it put on hold to complete. Still further, in the present non-limiting example, after a failed unlocking attempt, processor may be reset to receive a new code when any button is held in 2+ seconds and buttons blink yellow. In the present non-limiting example, with a failed unlocking attempt, any button may be held in 2+ seconds until buttons blink yellow once. Further, in the present non-limiting example, a full code may then be entered. Still further, in the present non-limiting example, if that entry is wrong a 3rd entry may be attempted however if that entry is wrong, the alarm would sound. In some embodiments, timer may pause based on specific user actions. In a non-limiting example, if user puts down device, device timer may pause until a user picks up device. In the present embodiment, if a first button has been pressed, device may determine whether a second button has been pressed in a step. In some embodiments, the device may determine whether a specific second button has been pressed. In other embodiments, the device may determine whether any button has been pressed. In the present embodiment, if a second button has been pressed, device may determine whether device timed out before second button was pressed in a step. In a non-limiting example, if a user fails to select correct second button within 20 seconds of selecting a first button, process may require any button be pressed 2+ seconds to reset for a second try. In the present embodiment, if device has not timed out, device may determine whether a third button has been pressed in a step. In some embodiments, the device may determine whether a specific third button has been pressed. In other embodiments, the device may determine whether any button has been pressed. In the present embodiment, if a second button has been pressed, device may determine whether device timed out before third button was pressed. Further, in the present embodiment, if device has not timed out, device may determine whether user has cancelled unlocking attempt in a step. In some embodiments, user may select a predetermined combination of buttons to cancel an unlocking attempt. In alternative embodiments, user may select a unique "cancel" button to cancel an unlocking attempt, or simply press any button 2+ seconds. In many embodiments, canceling an unlocking attempt may be equivalent to resetting of unlocking process. In the present embodiment, if user has not cancelled unlocking attempt, device may determine whether user's input was correct in a step. Further, in the present embodiment, if input was correct, device may unlock in a step. In some embodiments, various events may take place during unlocking of device. In a non-limiting example, a warning light and/or one or more other lights may blink to indicate declining time remaining. In yet another embodiment with a longer press on a button, all blue buttons briefly blink green, to signal a different input to the processor, and with a longer press on two buttons at once, all blue buttons briefly blink yellow to signal another input to the processor. In a non-limiting example, a single press can produce 12 different inputs, and two presses 144 combinations. In the present embodiment, if input was not correct, device may determine whether current unlocking attempt was user's third consecutive unlocking attempt in a step. In some embodiments, device may have a counter to keep track of user's failed attempts. In some of these embodiments, counter may reset after a certain amount of time. In the present embodiment, if current unlocking attempt is user's third consecutive attempt, device may activate an alarm. Further, in the present embodiment, device may block further entries for a specific period of time in a step. In a non-limiting example, device may block further entries for a period of 30 minutes. In some embodiments, device may allow any number of attempts prior to activating alarm and/or blocking further entries.

In a non-limiting example, user may change safety lever from a "safe" mode to a "fire" mode by moving user's thumb ½-inch forward, as opposed to approximately 4-inch motion in typical available solutions. In some embodiments, safety lever may automatically return from fire mode to safe mode upon user's thumb release of safety lever. In a non-limiting example, safety lever may automatically return to "safe" mode when user releases lever.

In many embodiments, a device may automatically engage various safety features after a certain period of inactivity while in timed unlocked mode. In a non-limiting example, a device may activate a motion detector and/or processor after a 10-minute period of inactivity by user, after warning light blinks yellow for 30 seconds. Some embodiments may incorporate a silent alarm which may activate when handled by an unauthorized user and/or when used in an unauthorized way.

In some embodiments, an unlocked device may remain unlocked for a specific amount of time. In a non-limiting example, an unlocked device may remain unlocked for a period of 10 minutes, blink a warning for 30 seconds then automatically relock. In the present non-limiting example, if the device motion detector detects movement during 10 minute period, time limits would be reset. In another non-limiting example, timer for unlocked period may be set anywhere between 30 seconds to 24 hours. In some embodiments, movement of device and/or pressing of buttons on device may reset timer.

In many embodiments, device buttons may have a variety of unique functions. In a non-limiting example, holding a first button for a given period of time may cause an alarm to sound until button is released. In another non-limiting example, holding a second button down for a given period may cause an alarm to sound until a predetermined code is entered on device buttons. In yet another non-limiting example, holding a third button for a given period may activate a silent alarm. In still another non-limiting example, holding multiple buttons for a given period may activate both an audio alarm and a silent alarm until a predetermined code is entered on device buttons.

In a non-limiting example, a smart AR 15 may be set to use a 2 to 4 personal press safety ("PPS") to unlock a gun. In the present non-limiting example, when an owner knows they made an entry mistake, the owner may release and re-grip the safety lever, or press any button 2.5 seconds until gun vibrates. Further, in the present embodiment, if their 2ed attempt is wrong, they may try again but a wrong 3ed attempt may cause the alarm to sound and a 30 minute lockout for code entries. In a non-limiting example, when the gun is locked the owner may pre-enter all but the last 1 or 2 numbers of the PPS, within 20 seconds of picking up the weapon, then put the weapon down which causes the motion detector and processor to stop countdown. In the present non-limiting example, the weapon may remember an entry and may accept last 1 or 2 presses, if entered within remainder of initial 20-second time period or anytime later. Further, in the present non-limiting example, if the owner or an unauthorized person picks up the weapon and makes a 3ed wrong entry within the of original 20-second time period, the alarm may sound and block all entries for 30 minutes.

In some embodiments, when the correct safety is entered the warning light and 3 button lights go off and the thumb safety lever may be pressed forward to also confirm the weapon is unlocked.

In many instances, the Smart safety selector lever may go from safe to fire settings faster than current AR 15s and military firearms in about ½" instead of 4" of thumb travel, and may automatically returns to safe when released. Both of these features may be seen as significant improvements. As the weapon may be used in a gun fight with an enemy, minimal movement to release the safety could be critical.

In some embodiments, the personal press safety must be entered to unlock the automatic electronic trigger lock, and if not, the trigger remains locked. In some of these embodiments, the smart thumb safety cannot be pushed forward, confirming to the owner that the automatic electronic was engaged. In some embodiments, the motion detector and processor would reengage the smart safety when the weapon was put down and not moved for, in a non-limiting example, 10 minutes. In another non-limiting example, in a military setting the smart electronic safety could be unlocked for extended periods such as a day or week and automatically re-engaged after a brief time when the weapon was put down as determined by the processor and motion detector. In some embodiments, if an unauthorized attempt is made to handle or steal the weapon, a loud alarm may sound. In many embodiments, if somehow the weapon is acquired by an enemy while unlocked, it would automatically re-lock as programmed. Moreover, in some embodiments, the silent alarm safety option may be employed in military deployment.

In one embodiment when the personal press safety is entered, the weapon may be programmed to remain unlocked for 24 hours, however lack of movement for 10 minutes, e.g. due to the weapon being put down, may cause relocking after a warning period. In a non-limiting example, a warning period may be one minute. In other embodiments, the 10 minute no motion automatic relock setting may be reprogrammed to between 30 seconds to 24 hours.

In some embodiments, holding button 1 in 2.5+ seconds may cause the audio alarm to sound until released, holding button 2 in 2.5+ seconds may cause the audio alarm to sound until the PPS is entered, holding button 3 in 2.5+ seconds may cause silent alarm to sound, and/or holding buttons 2 and 3 in 2.5+ seconds may cause both audio and silent alarms to sound until PPS entered.

In one embodiment of the present invention, the processor may be operable to provide numerous other functions for the firearm safety assembly, including, without limitation, communicating with the thumb safety lever, communicating with push buttons, communicating with warning lights, communicating with the smart control module, communicating with the motor, communicating with the power source and the alternative power source, communicating with the motion detector/accelerometer, communicating with the audible alarm, communicating with the silent alarm, communicating with a GPS, communicating with digital image recording component communicating with the vibration motor, communicating with an internal FM transmitter, communicating with a law enforcement agency, communicating with a private security company, communicating with the keyboard, communicating with status lights in the keyboard, communicating with the firearm owner that the power source, which may be batteries are weak, and that they should be replaced. In some embodiments, upon the motion detector sensing movement and/or receiving a predetermined PPS from the smart control module, the processor may actuate the motor for positioning the blocker into the unlocked mode. In one or more embodiments, the power source may include, without limitation, 2 or 4-1.5 volt AAAA batteries, a volt battery, coin batteries . . . . In some embodiments, the processor through the lights would communicate to the owner that the power supply needed replacement.

In one alternative embodiment, the processor may record and transmit all activity of the firearm locking assembly to a remote processor. In some embodiments, the firearm locking assembly may include an external power port for docking with an external power source in the event of battery failure. In one embodiment of the present invention, the firearm may include a keyboard having colored LED lights and a vibrating motor. In some embodiments, lights and/or vibrating motor may light or vibrate to indicate various signals, including, without limitation, when the authorized user successfully unlocks or commands the firearm, warn a child or owner to put the firearm down, or other status of the mechanism. In at least one embodiment, forward and/or rearward facing digital camera image sensors may be located in the smart safety control module or in the forward end of the receiver.

In some embodiments, an alternative power source may commence generating power when the personal identification number is entered, or when the processor communicates to the alternative power source. In some of these embodiments, the power source may include, without limitation, a battery, and a thermal power source. In one embodiment, the power source may be positioned below and adjacent to the motor.

In a non-limiting example, a military assault-type firearm processor may require a new entry code be entered every day, week or month as provided by the military. In the present non-limiting example, military or our CIA could retain control of firearms supplied to foreign fighters beyond one day.

In one alternative embodiment, the processor may be programmed to switch between modes during various times in a 24 hour period. For example, without limitation, the firearm locking assembly may switch to unlocked mode during working hours in the day, and then switch to locked mode during the night. Those skilled in the art, in light of the present teachings, will recognize that firearms used for hunting such as rifles and shotguns may include automatic relocking by releasing the restriction portion. In some embodiments, the restriction portion, however, may be replaced with the processor timing programming automatically implementing the safety mode including the motion detector, alarm portion, and locking the trigger.

Figure 4:
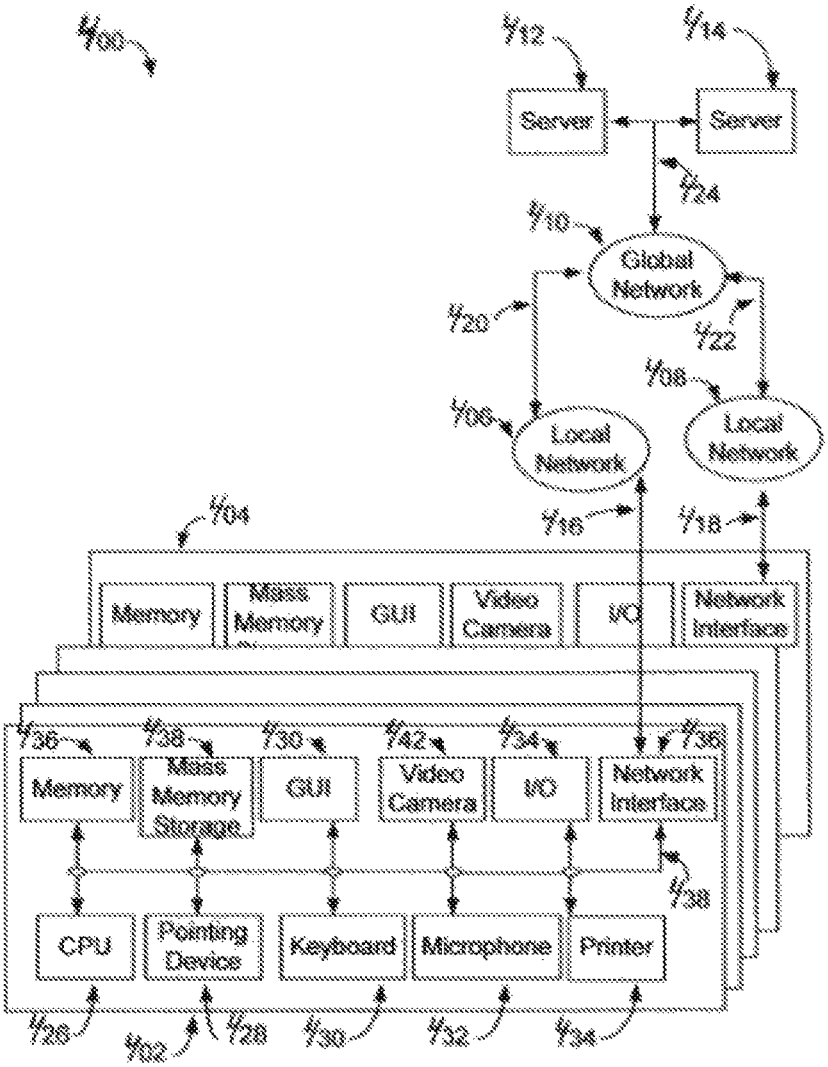
FIG. 4 illustrates a typical computer system that, when appropriately configured or designed, may function in an exemplary firearm locking assembly, in accordance with an embodiment of the present invention.

FIG. 4 illustrates a typical computer system that, when appropriately configured or designed, can serve as an exemplary tracking system, in accordance with an embodiment of the present invention. In the present invention, a communication system 400 includes a multiplicity of clients with a sampling of clients denoted as a client 402 and a client 404, a multiplicity of local networks with a sampling of networks denoted as a local network 406 and a local network 408, a global network 410 and a multiplicity of servers with a sampling of servers denoted as a server 412 and a server 414. It should be understood processor 212 and 312 FIGS. 2 and 3 may be used as computer system FIG. 4.

Client 402 may communicate bi-directionally with local network 406 via a communication channel 416. Client 404 may communicate bi-directionally with local network 408 via a communication channel 418. Local network 406 may communicate bi-directionally with global network 410 via a communication channel 420. Local network 408 may communicate bi-directionally with global network 410 via a communication channel 422. Global network 410 may communicate bi-directionally with server 412 and server 414 via a communication channel 424. Server 412 and server 414 may communicate bi-directionally with each other via communication channel 424. Furthermore, clients 402, 404, local networks 406, 408, global network 410 and servers 412, 414 may each communicate bi-directionally with each other.

In one embodiment, global network 410 may operate as the Internet. It will be understood by those skilled in the art that communication system 400 may take many different forms. Non-limiting examples of forms for communication system 400 include local area networks (LANs), wide area networks (WANs), wired telephone networks, wireless networks, or any other network supporting data communication between respective entities.

Clients 402 and 404 may take many different forms. Non-limiting examples of clients 402 and 404 include personal computers, personal digital assistants (PDAs), cellular phones and smartphones.

Client 402 includes a CPU 426, a pointing device 428, a keyboard 430, a microphone 432, a printer 434, a memory 436, a mass memory storage 438, a GUI 440, a video camera 442, an input/output interface 444 and a network interface 446.

CPU 426, pointing device 428, keyboard 430, microphone 432, printer 434, memory 436, mass memory storage 438, GUI 440, video camera 442, input/output interface 444 and network interface 446 may communicate in a unidirectional manner or a bi-directional manner with each other via a communication channel 448. Communication channel 448 may be configured as a single communication channel or a multiplicity of communication channels.

CPU 426 may be comprised of a single processor or multiple processors. CPU 426 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 436 is used typically to transfer data and instructions to CPU 426 in a bi-directional manner. Memory 436, as discussed previously, may include any suitable computer-readable media, intended for data storage, such as those described above excluding any wired or wireless transmissions unless specifically noted. Mass memory storage 438 may also be coupled bi-directionally to CPU 426 and provides additional data storage capacity and may include any of the computer-readable media described above. Mass memory storage 438 may be used to store programs, data and the like and is typically a secondary storage medium such as a hard disk. It will be appreciated that the information retained within mass memory storage 438, may, in appropriate cases, be incorporated in standard fashion as part of memory 436 as virtual memory.

CPU 426 may be coupled to GUI 440. GUI 440 enables a user to view the operation of computer operating system and software. CPU 426 may be coupled to pointing device 428. Non-limiting examples of pointing device 428 include computer mouse, trackball and touchpad. Pointing device 428 enables a user with the capability to maneuver a computer cursor about the viewing area of GUI 440 and select areas or features in the viewing area of GUI 440. CPU 426 may be coupled to keyboard 430. Keyboard 430 enables a user with the capability to input alphanumeric textual information to CPU 426. CPU 426 may be coupled to microphone 432. Microphone 432 enables audio produced by a user to be recorded, processed and communicated by CPU 426. CPU 426 may be connected to printer 434. Printer 434 enables a user with the capability to print information to a sheet of paper. CPU 426 may be connected to video camera 442. Video camera 442 enables video produced or captured by user to be recorded, processed and communicated by CPU 426.

CPU 426 may also be coupled to input/output interface 444 that connects to one or more input/output devices such as such as CD-ROM, video monitors, track balls, mice, keyboards, microphones, touch-sensitive displays, transducer card readers, magnetic or paper tape readers, tablets, styluses, voice or handwriting recognizers, or other well-known input devices such as, of course, other computers.

Finally, CPU 426 optionally may be coupled to network interface 446 which enables communication with an external device such as a database or a computer or telecommunications or internet network using an external connection shown generally as communication channel 416, which may be implemented as a hardwired or wireless communications link using suitable conventional technologies. With such a connection, CPU 426 might receive information from the network, or might output information to a network in the course of performing the method steps described in the teachings of the present invention.

Those skilled in the art will readily recognize, in light of and in accordance with the teachings of the present invention, that any of the foregoing steps and/or system modules may be suitably replaced, reordered, removed and additional steps and/or system modules may be inserted depending upon the needs of the particular application, and that the systems of the foregoing embodiments may be implemented using any of a wide variety of suitable processes and system modules, and is not limited to any particular computer hardware, software, middleware, firmware, microcode and the like. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing firearm locks that operate by command of a processor and an access code, and include an alarm to warn against unauthorized users according to the present invention will be apparent to those skilled in the art. Various aspects of the invention have been described above by way of illustration, and the specific embodiments disclosed are not intended to limit the invention to the particular forms disclosed. The particular implementation of the firearm locks that operate by command of a processor and an access code, and include an alarm to warn against unauthorized users may vary depending upon the particular context or application. By way of example, and not limitation, the firearm locks that operate by command of a processor and an access code, and include an alarm to warn against unauthorized users described in the foregoing were principally directed to locking firearms against unauthorized users implementations; however, similar techniques may instead be applied to tools in a scientific laboratory or construction site, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

I claim:

1. An apparatus, comprising:

a trigger assembly configured to initiate and to prevent a firing of a firearm, said trigger assembly including a pivot, a trigger block extending in a first rearward direction from the pivot, and a trigger extending in a second, downward direction from the pivot;

a safety selector lever positioned on the firearm, said safety selector lever configured to have an on position accessible to a user's thumb of a hand while the hand holds a grip of the firearm, said safety selector lever being rotatable by the user's thumb to an off position through an angle of rotation of said safety selector lever from said on position to said off position so that the user is able to operate said trigger assembly while said safety selector lever is positioned in said off position by the thumb;

a safety cam positioned in a location that is on an opposite side of the trigger block from the grip of the firearm, the safety cam engaged with a pivot end of said safety selector lever, the safety cam configured to engage said trigger block of the trigger assembly to inhibit firing of the firearm when the safety selector lever and the safety cam are in a safety engaged position, and the safety cam configured to disengage from said trigger block to enable firing of the firearm when the safety selector lever and the safety cam are in a safety disengaged position, the safety cam including a recess portion facing downwardly in alignment with an upwardly angled feature of said trigger block in the safety disengaged position so that when said trigger is pulled, a rear portion of said trigger block rotates upwardly so that said trigger block rotates into said safety cam recess, said trigger block rotation when said trigger is pulled being allowed by a recess of said trigger block and said recess in the safety cam, which in turn allows a desired minimum safety selector lever rotation to allow the firearm to be fired; and a safety selector lever return mechanism configured to return said safety selector lever to said on position when the user's thumb is removed from said safety selector lever.

2. The apparatus as recited in claim 1, wherein the safety selector lever return mechanism further comprises a spring configured to return said safety selector lever to said on position when the user's thumb is removed.

3. The apparatus of claim 1, wherein the upwardly angled feature of said trigger block is a protrusion positioned to extend in a direction that is away from the grip.

4. The apparatus of claim 3, wherein the trigger assembly includes a front end and a rear end, the protrusion is positioned closer to the rear end than the trigger, and the protrusion and said trigger extend from the trigger assembly in opposite directions.

5. The apparatus of claim 3, wherein the protrusion is positioned in an internal location of the firearm.

6. The apparatus of claim 1, wherein the trigger assembly rotates about a trigger pivot including an axis of rotation, and said safety selector lever rotates about a lever pivot including an axis of rotation, and the trigger axis of rotation and the lever axis of rotation extend generally in the same direction.

7. The apparatus of claim 6, wherein rotation of said safety selector lever about the lever axis of rotation from the safety engaged position to the safety disengaged position is in a first direction of rotation, and rotation of the trigger assembly about the trigger axis of rotation with a pull of said trigger by the user is in a second, opposite direction of rotation.

8. The apparatus of claim 1, wherein said trigger block extends a spaced distance from said trigger in the first rearward direction such that the trigger block is positioned along a line extending from the grip to the safety cam, and said trigger extends a spaced distance from said trigger block in the second, downward direction.

9. The apparatus of claim 1, wherein said safety selector lever return mechanism includes a bias device.

* * * * *